United States Patent [19]

Richter

[11] 4,239,201

[45] Dec. 16, 1980

[54] PLEAT-AND-PINCH FOLDING APPARATUS

[75] Inventor: Johannes Richter, Augsburg, Fed. Rep. of Germany

[73] Assignee: Maschinenfabrik Augsburg-Nurnberg Aktiengesellschaft, Augsburg, Fed. Rep. of Germany

[21] Appl. No.: 16,989

[22] Filed: Mar. 2, 1979

[30] Foreign Application Priority Data

Apr. 7, 1978 [DE] Fed. Rep. of Germany ..... 2815077

[51] Int. Cl.[3] ..... B65H 45/18

[52] U.S. Cl. ..... 493/444

[58] Field of Search ..... 270/67, 80–85

[56] References Cited

U.S. PATENT DOCUMENTS

| | | | |
|---|---|---|---|
| 259,978 | 6/1882 | Crowell | 270/83 |
| 2,172,361 | 9/1939 | Clauberg | 270/83 |

*Primary Examiner*—Edgar S. Burr
*Assistant Examiner*—A. Heinz
*Attorney, Agent, or Firm*—Frishauf, Holtz, Goodman & Woodward

[57] ABSTRACT

To eliminate the need for braking sheets or webs being fed to a pleat-and-pinch folding apparatus, a pleating blade, suspended to fold sheets in the nip between folding rollers is arranged for reciprocating movement in the direction of feed of the sheets or web, conjointly with movement of the rollers so that the moving sheet is being creased and pushed into the nip between the rollers while it still has a longitudinal movement component, which is synchronized essentially with the axial movement of the rollers and the longitudinal movement of the pleating blade. The longitudinal movement of the sheet or web is stopped after the sheet has been gripped between the rollers and as it is being fed to a further transport arrangement, return movement of the rollers and the blade being effected between feeds of subsequent sheets. The axial movement of the roller and the longitudinal movement of the pleating blade can be controlled by cams, eccenters and the like.

9 Claims, 4 Drawing Figures

PLEAT-AND-PINCH FOLDING APPARATUS

The present invention relates to a pleat-and-pinch folding apparatus for use with rotary printing machines, and more particularly to the type of apparatus in which a pleating blade which is vertically reciprocable forms a crease and then a pleat in a web of paper, which is then caught between a pair of pinch rollers to squeeze the then folded web of paper together and form the paper fold.

BACKGROUND AND PRIOR ART

Pleat-and-pinch folding apparatus is known. Usually a reciprocating pleating blade is vertically reciprocated, transverse to the plane of transport of the paper web to push the paper web into the nip between a pair of rollers which rotate against each other and with the same speed. This type of apparatus is frequently used with multiple-layer webs, that is, with webs which have been prefolded in a folding former. A description of such an apparatus is found in the by Alexander Braun "Der Tiefdruck", Frankfurt am Main, 1952, pages 150, 151; 154; 155; 207, 208 ("Gravure Printing"). This arrangement has the disadvantage that the pleat can be applied to the web only when the printed web is stationary. In order to stop a printed web, being ejected or fed from a printing machine, a brake is necessary which usually is formed with a stop or abutment sheet or edge. Braking a moving web of paper at times introduces distortions or twists of the printed web; the abutment can damage the edge of the printed material which is fed thereagainst, particularly if the feed of the printed material is comparatively fast.

THE INVENTION

It is an object to provide a pleat-and-pinch folding apparatus in which a longitudinal fold can be formed by using a reciprocating pleating blade and which permits operation on a moving sheet, that is, a web—which may be in multiple layers—of printed paper.

Briefly, the pleating blade is caused not only to reciprocate in a direction transverse to the plane of movement of the web, but additionally in the direction of feed of the web to the folding apparatus; the pinch rollers, likewise, are being moved in this transport direction of the web so that the pleating and pinching operation can be carried out on the web—which may be in multiple layers—which is still moving in the transport direction.

The system thus folds the web, which may be in multiple layers, as it is moving. No special sheet brakes or abutment elements are needed, thus preventing distortion or warping of the web, and preventing any damage to the leading edge of the web. The arrangement has the additional advantage that the time to make the fold can be decreased so that the overall production speed of the printing-and-folding machine combination can be increased.

Figure 1:
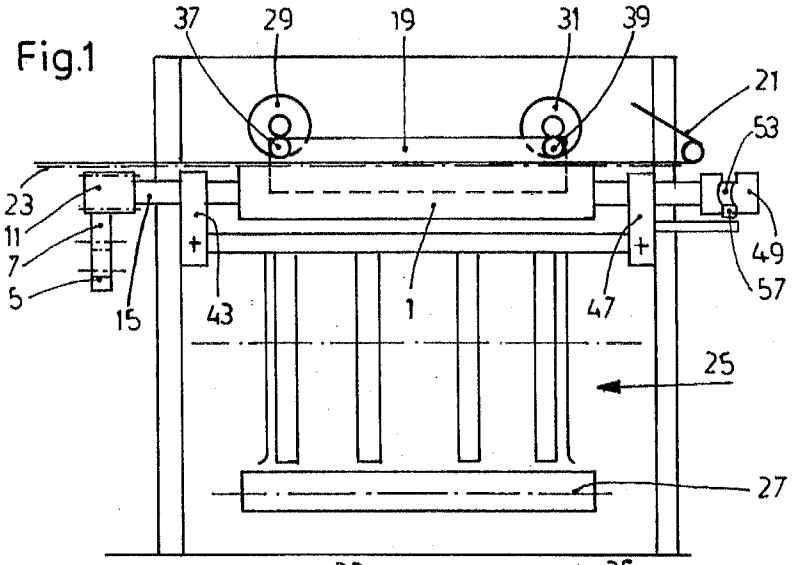
Figure 3:
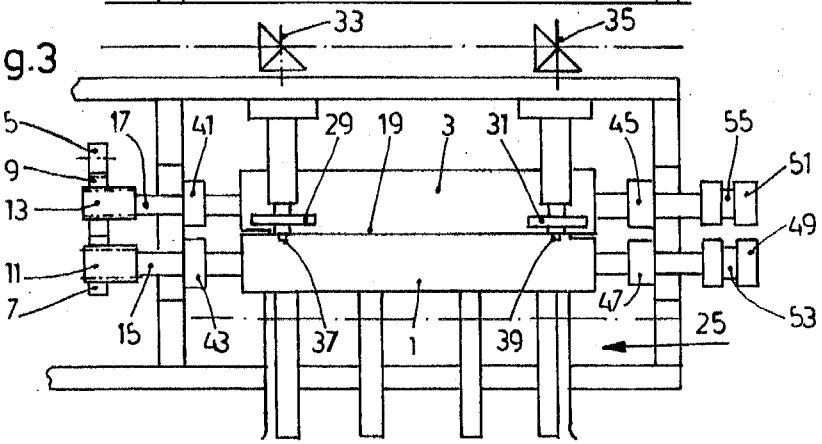
Figure 2:
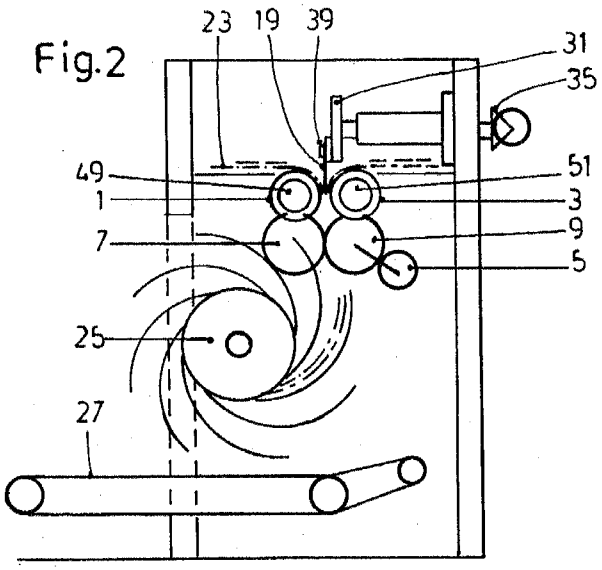

Drawings, illustrating preferred examples:

FIG. 1 is a side view of the apparatus;

FIG. 2 a front view;

FIG. 3 a top view in accordance with one embodiment; and

Figure 4:
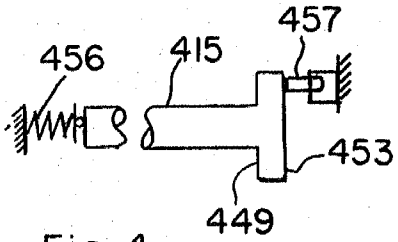

FIG. 4 a fragmentary top view illustrating an alternate form of obtaining longitudinal shift of the pinch rollers, in highly schematic representation.

Two pinch rollers 1, 3 are driven by a pinion 5 over intermediate gears 7, 9 and end gears 11, 13, which are secured to the shafts 15, 17 of the pinch rollers 1, 3. The pinch rollers rotate in opposite direction. The end gears 11, 13 are axially longer than the intermediate gears 7, 9 in order to permit axial shifting of the shafts 15, 17, and hence of the gears 11, 13.

A pleating blade 19 is located above the nip between the rollers 1, 3. The blade operates vertically, transverse to an imaginary plane passing through the axis of the shafts 15, 17, and suspended for vertically reciprocating motion.

Printed sheets 23 are conducted from a printing machine, for example a rotary printing machine, by a transport mechanism 21, typically a belt, to have their fold line placed above the nip of the rollers 1, 3. They are pushed by the pleating blade 19 into the nip, so that the sheets are gripped by the rotating rollers 1, 3, are folded together, and transported downwardly to be received by a paddle wheel distributor 25 which further transports the folded sheets to a removal conveyor 27.

The sheets 23, as schematically indicated in FIG. 2, may be multiple-ply, that is, a plurality of individual sheets are superimposed above each other and folded in one common folding operation. The sheets, which are fed from left to right in the views of FIGS. 1 and 3, are usually transported to the folding machine with substantial speed in the direction of the longitudinal fold. In prior art structures, the sheets were braked, and conducted up to a stop element in order to be properly folded. This led to warping and distortion, and damage of the sheets at their leading edge.

In accordance with the invention, and in order to reduce the time required to fold the sheets, the elements which are directly involved with the folding operation, namely the pinching rollers 1 and 3 and the pleating blade 19, are moved in the direction of feed movement of the sheets. The movement is so synchronized that, at the initial engagement, the speed of movement is essentially the same as the speed of feed of the sheets so that there is no essential relative movement between the elements 1, 3, 19 and the sheets 23 until the sheets 23 are securely gripped between the rollers 1, 3 and can then be braked when they are being gripped by control of the movement of the rollers in axial direction. The braking thus may be effected gently, without impairing the integrity of the edges, and particularly the leading edges, of the sheets being fed.

The pleating blade 19, in accordance with a feature of the invention, is suspended at its ends on two eccenter disks 29, 31, respectively, which are driven by angle drives 33, 35 (FIG. 3) in the same direction of rotation. The eccenter disks 29, 31 carry bearing pins 37, 39 which engage in corresponding openings of the pleating blade 19 so that, upon rotation of the eccenter disks, the pleating blade will carry out not only a reciprocating up-and-down motion, but additionally a longitudinal movement. The up-and-down motion, as well as the longitudinal to-and-fro movement of the pleating blade is so synchronized with the transport speed of the transport belt 21 feeding the sheets 23 that the downward movement of the blade 19 and the forward movement thereof concur essentially in synchronism with the movement of the printed sheet or sheets 23; the upward and the return movement of the blade 23 will then occur while the blade is between the already gripped sheets as they are being folded.

The rollers 1, 3 carry out axially longitudinal movement in the same manner as the blade 19, in order to prevent undesirable friction of the sheets 23, and specifically of the sheet which is in engagement with the rollers 1, 3. The shafts 15, 17 on which the rollers 1, 3 are secured are journalled in bearings 41, 43, 45, 47 which permit axial shifting. The gears 11, 13 are wide enough to be engaged with the intermediate drive gears 7, 9 at all times during the axial movement of the rollers 1, 3. To effect axial movement, the shafts 15, 17 have cam tracks 49, 51 positioned at their ends, typically in the form of cam-carrying bushings or sleeves formed with a groove which are in engagement with stationary fixed cam rollers 57. The cam grooves 53, 55 formed in the cam elements 49, 51 force axial movement of the shafts 15, 17 and hence of the rollers 1, 3 when driven by the pinion 5 and the intermediate gears 7, 9 and the end gears 11, 13. Only one fixed cam follower roller 57 is shown in FIG. 1 for simplicity. The longitudinal movement is so synchronized with the feed movement of the printed sheets 23 that the forward movement of the rollers—in the feed direction of the sheets 23—is concurrent with the feeding movement of the sheet, or sheets 23, and the return movement is effected in the gap between the feed of two sequential sheets 23, or stacks of sheets 23. This movement can readily be controlled by suitable shaping of the cam groove, as well known.

The relative movement between the folding rollers 1, 3 and the pleating blade 19, on the one hand, and the printed sheets 23 or stacks of sheets 23, on the other, is thus effectively avoided. Braking of the printed sheets 23 for further transport through the paddle wheel distributor 25 and the subsequent conveyor 27 is carried out without force being applied against the edges of the sheets and during the return movement of the pinch rollers 1, 3. The shape of the cam tracks 53, 55 is suitably so selected that the printed sheets, or stacks of sheets 23 will have longitudinal speed zero—in the previous feed direction—when they leave the nip between the rollers 1, 3.

In some cases it may be desirable to skew the pleating blade 19 with respect to the plane of feed of the sheets 23, thereby obtaining slightly better guidance of the sheets 23 into the nip between the rollers 1, 3. This can be readily obtained by change of the phase positions of the eccenter pins 37, 39 on the eccenter disks 29, 31, or of the disks themselves; for example, one of the eccenter disks, disk 29, can be rotated manually relative to disk 31, or the pins 37, 39 can be moved to differently positioned engagement holes in the blade 19 or in the disk 29, 31, respectively, so that one pin starts it downward motion a little earlier than the other. Similarly, the phase position of the eccenter disks 29, 31 can be changed with respect to the curve elements 49, 51 by conjoint rotation of the curve elements 49, 51 so that the entire arrangement can easily be matched to different thicknesses of the sheets 23, or the number of sheets in the stack 23.

The relative rotation between the eccenter disks 29, 31 and of the shafts 15, 17 is usually so selected that the blade 19 has a vertical speed upon engagement towards the nip between the rollers 1, 3 which is about the same as the surface speed of the rollers 1, 3. To match operation to different thicknesses of the stacks, or different thicknesses of the webs or sheets 23, and to obtain a fold line which is more or less sharp, it can be desirable to slightly change the speed of the eccenter disks 29, 31 with respect to the speed of shaft 15, 17 so that the blade 19 has a linear speed downwardly which is slightly more or slightly less than the linear surface speed of the counter rotating rollers 1, 3.

Various changes and modifications may be made; for example, the control contour of the cam elements 49, 51 can be arranged differently than a circumferential cam track 53, 55. Other arrangements can be selected to provide for controlled axial movement of the shafts 15, 17. FIG. 4 illustrates one such modification, in which the control track 453 is formed on the free end of a cam disk 449, the control track being engaged by a fixed cam roller 457. The shaft 415 of the respective roller is continuously pressed towards the right, that is, to engage the roller 457 with the cam track 453 by a spring 456 which, for example, bears with an end ball in a slightly central spherical depression formed in the shaft 415.

The disks 29, 31 rotate with the same speed so that adjustment of the eccenter pins 37, 39, if desired, is simple.

Various other changes and modifications may be made within the scope of the inventive concept.

I claim:

1. For use with a rotary printing press to form a paper sheet, or stack of paper sheets (23) with a fold line extending longitudinally in a direction of transport feed of the sheet, or stack of sheets through the printing machine, a pleat-and-pinch folding apparatus having an elongated reciprocating pleating blade (19) positioned parallel to the direction of feed of the sheet and reciprocating transverse to its major dimension;

two pinch rollers (1, 3) located beneath the pleating blade (19) and defining an elongated nip therebetween positioned parallel to the direction of feed of the sheet to receive the sheet or sheets upon being pushed into the nip by the reciprocating blade, and comprising, in accordance with the invention, a pleating blade suspension means (29, 31, 37, 39) moving the pleating blade (19) in a longitudinal direction parallel to its length during reciprocating movement of the blade; and roller moving means (41, 43, 45, 47, 15, 17, 49, 51) for moving the pinch rollers axially in a longitudinal direction parallel to the feed direction, wherein the longitudinal movement of both the pleating blade and pinch rollers is effected simultaneously with the sheet or sheets being pushed by said blade into said nip for folding the sheet or sheets.

2. Apparatus according to claim 1, wherein the pleating blade suspension means comprises two rotary eccentric means (29, 31, 37, 39) suspending the pleating blade (19) in the region of its ends, and rotating at the same speed.

3. Apparatus according to claim 2, wherein the eccentric means includes means for adjustably suspending the respective ends of the blade independently of one another.

4. Apparatus according to claim 2, wherein the eccentric means comprise eccenter disks (29, 31) and eccentrically located pins (37, 39) suspending the blade (19) on said disks.

5. Apparatus according to claim 1, wherein the roller moving means comprises bearings (41, 43, 45, 47) permitting axial movement of the shafts (15, 17) of the rollers in the bearings;

and cam means (49, 51; 449, 453) secured to the shafts (15, 17) of the rollers (1, 3) for effecting axial shifting movement of the shafts, and hence of the rollers, the cam means having an axially contoured cam surface and a fixed cam follower (57, 457) in engagement with the contoured cam surface.

6. Apparatus according to claim 5, wherein the cam means comprises (FIG. 3) a cam sleeve (49, 51) having a circumferential cam track therein, and the cam follower comprises a fixed roller (57) engaged in said track.

7. Apparatus according to claim 5, wherein (FIG. 4) the cam means comprises an end disk (449) having said contoured cam surface (453) located at a facing end thereof, and the cam follower comprises a roller in engagement with said surface;

and spring means (456) are provided in engagement with a respective shaft (415) carrying the cam disk and maintaining resilient engagement of said roller with said cam surface.

8. Apparatus according to claim 5, wherein the pleat blade suspension means comprises two eccentric means; and includes means for adjustably suspending the respective ends of the blade independently of one another.

9. Apparatus according to claim 5, wherein the pleating blade suspension means comprises rotary eccentric means;

and the speed of the rotary eccentric means is variable with respect to the speed of the cam means.

* * * * *